US005089225A

United States Patent [19]

Huang

[11] Patent Number: 5,089,225

[45] Date of Patent: Feb. 18, 1992

[54] HIGH-NIOBIUM TITANIUM ALUMINIDE ALLOYS

[75] Inventor: Shyh-Chin Huang, Latham, N.Y.

[73] Assignee: General Electric Company, Schenectady, N.Y.

[21] Appl. No.: 695,043

[22] Filed: May 2, 1991

Related U.S. Application Data

[63] Continuation of Ser. No. 445,306, Dec. 4, 1989, abandoned.

[51] Int. Cl.[5] ..... C22C 14/00

[52] U.S. Cl. ..... 420/418; 420/580; 148/407; 148/419; 148/421; 148/442

[58] Field of Search ..... 420/418, 419, 420, 580; 148/421, 419, 407, 442

[56] References Cited

U.S. PATENT DOCUMENTS

| | | | |
|---|---|---|---|
| 3,008,823 | 11/1961 | McAndrew | 420/418 |
| 4,294,615 | 10/1981 | Blackburn et al. | 420/420 |
| 4,661,316 | 4/1987 | Hashimoto et al. | 420/418 |
| 4,788,035 | 11/1988 | Gigliotti, Jr. et al. | 420/420 |

FOREIGN PATENT DOCUMENTS

| | | |
|---|---|---|
| 1-042539A | 2/1989 | Japan . |
| 1-298127A | 12/1989 | Japan . |
| 2060693A | 5/1981 | United Kingdom . |
| 2060694A | 5/1981 | United Kingdom . |

OTHER PUBLICATIONS

Sastry, S. M. L. and Lipsitt, H. A., "Plastic Deformation of TiAl and Ti-3Al", Air Force Wright Aeronautical Labs., National Research Council, Titanium 80,2(1980) pp. 1231-1243.

Sastry, S. M. L. and Lipsitt, H. A., "Fatigue Deformation of TiAl Base Alloys", Metallurgical Transactions A, vol. 8A (Feb. 1977) pp. 299-308.

Blackburn, M. J., Ruckle, D. L., and Bevan C. E., "Research to Conduct an Exploratory Experimental and Analytical Investigation of Alloys", Technical Report AFML-TR-78-18 (Mar. 1978).

McAndrew, J. B. and Kessler, H. D., "Ti-36 Pct Al as a Base for High Temperature Alloys", Journal of Metals, Transactions AIME, vol. 206 (Oct. 1956) pp. 1348-1353.

Zelenkov, I. A. and Martynchuk, E. N., "Thermal Stability of Compounds of TiAl with Niobium at 800° and 1000° C.", Metallofizika, No. 42 (1971) pp. 63-66.

Zelenkov, I. A. and Martynchuk, E. N., "Heat Resistance of TiAl-Based Alloys at 100° C.", Samoletostr. Tekh, Vozdush, Flota, 31 (1973) pp. 115-119.

Akad. Nauk, Ukrain. SSR, Metallofizikay, No. 50 (1974).

*Primary Examiner*—R. Dean
*Assistant Examiner*—Margery S. Phipps
*Attorney, Agent, or Firm*—Paul E. Rochford; James C. Davis, Jr.; James Magee, Jr.

[57] ABSTRACT

A TiAl composition is prepared by ingot metallurgy to have higher strength and to have moderately reduced or improved ductility by altering the atomic ratio of the titanium and niobium to have what has been found to be a highly desirable effective aluminum concentration and by addition of niobium according to the approximate formula $Ti_{48-37}Al_{46-49}Nb_{6-14}$.

10 Claims, 4 Drawing Sheets

HIGH-NIOBIUM TITANIUM ALUMINIDE ALLOYS

This application is a continuation of application Ser. No. 07/445,306, filed 12/04/89.

CROSS-REFERENCE TO RELATED APPLICATIONS

The subject application relates to copending applications which have since been issued as U.S. Pat. Nos. 4,836,983; 4,842,819; 4,842,817; 4,842,820; and 4,857,268.

The texts of these related applications are incorporated herein by reference.

BACKGROUND OF THE INVENTION

The present invention relates generally to alloys of titanium and aluminum. More particularly, it relates to alloys of titanium and aluminum which have been modified both with respect to stoichiometric ratio and with respect to niobium addition and which contain a higher concentration of niobium additive.

It is known that as aluminum is added to titanium metal in greater an greater proportions the crystal form of the resultant titanium aluminum composition changes. Small percentages of aluminum go into solid solution in titanium and the crystal form remains that of alpha titanium. At higher concentrations of aluminum (including about 25 to 35 atomic %) an intermetallic compound $Ti_3Al$ is formed. The $Ti_3Al$ has an ordered hexagonal crystal form called alpha-2. At still higher concentrations of aluminum (including the range of 50 to 60 atomic % aluminum) another intermetallic compound, TiAl, is formed having an ordered tetragonal crystal form called gamma.

The alloy of titanium and aluminum having a gamma crystal form and a stoichiometric ratio of approximately one is an intermetallic compound having a high modulus, a low density, a high thermal conductivity, good oxidation resistance, and good creep resistance. The relationship between the modulus and temperature for gamma TiAl compounds to other alloys of titanium and in relation to nickel base superalloys is shown in FIG. 1. As is evident from the figure the gamma TiAl has the best modulus of any of the titanium alloys. Not only is the gamma TiAl modulus higher at temperature but the rate of decrease of the modulus with temperature increase is lower for gamma TiAl than for the other titanium alloys. Moreover, the gamma TiAl retains a useful modulus at temperatures above those at which the other titanium alloys become useless. Alloys which are based on the gamma TiAl intermetallic compound are attractive lightweight materials for use where high modulus is required at high temperatures and where good environmental protection is also required.

One of the characteristics of gamma TiAl which limits its actual application to such uses is a brittleness which is found to occur at room temperature. Also, the strength of the intermetallic compound at room temperature needs improvement before the gamma TiAl intermetallic compound can be exploited in structural component applications. Improvements of the gamma TiAl intermetallic compound to enhance ductility and/or strength at room temperature are very highly desirable in order to permit use of the compositions at the higher temperatures for which they are suitable.

With potential benefits of use at light weight and at high temperatures, what is most desired in the gamma TiAl compositions which are to be used is a combination of strength and ductility at room temperature. A minimum ductility of the order of one percent is acceptable for some applications of the metal composition but higher ductilities are much more desirable. A minimum strength for a composition to be useful is about 50 ksi or about 350 MPa. However, materials having this level of strength are of marginal utility and higher strengths are often preferred for some applications.

The stoichiometric ratio of TiAl compounds can vary over a range without altering the crystal structure. The aluminum content can vary from about 50 to about 60 atom percent. The properties of TiAl compositions are subject to very significant changes as a result of relatively small changes of one percent or more in the stoichiometric ratio of the titanium and aluminum ingredients. Also, the properties are similarly affected by the addition of relatively similar small amounts of ternary elements.

PRIOR ART

There is extensive literature on the compositions of titanium aluminum including the $Ti_3Al$ intermetallic compound, the TiAl intermetallic compounds and the $TiAl_3$ intermetallic compound. A patent, U.S. Pat. No. 4,294,615, entitled "TITANIUM ALLOYS OF THE TiAl TYPE" contains an extensive discussion of the titanium aluminide type alloys including the TiAl intermetallic compound. As is pointed out in the patent in column 1, starting at line 50, in discussing TiAl's advantages and disadvantages relative to $Ti_3Al$:

> "It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

> "Those well skilled recognize that there is a substantial difference between the two ordered phases. Alloying and transformational behavior of $Ti_3Al$ resemble those of titanium, as the hexagonal crystal structures are very similar. However, the compound TiAl has a tetragonal arrangement of atoms and thus rather different alloying characteristics. Such a distinction is often not recognized in the earlier literature."

The '615 patent does describe the alloying of TiAl with vanadium and carbon to achieve some property improvements in the resulting alloy.

It should be pointed out, however, with regard to the '615 patent that there are many alloys listed in the Table 2 of this patent reference but the fact that a composition is listed should not be taken as an indication that any alloy which is listed is a good alloy. Most of the alloys which are listed have no indication of any properties. For example, alloy IT2A-119 of Table II is listed as Ti-45Al-1.0Hf in atomic %. This alloy corresponds to alloy 32 of applicant's Table II. The composition listed by the applicant in Table II is $Ti_{54}Al_{45}Hf_1$ so that it is precisely the same composition in atomic % as that listed and referred in Table II of the '615 reference. However, as is evident from the applicant's Table II, the titanium base alloy containing 45 aluminum and 1.0 hafnium is a very poor alloy having very poor ductility and, accordingly, having no valuable properties and no use as a titanium base alloy. The alloy Ti-45Al-5.0Nb is listed in Table 2 in the same fashion, i.e., without any listing of properties or indication that the alloy has any use or any value.

A number of technical publications dealing with the titanium aluminum compounds as well as with the characteristics of these compounds are as follows:

1. E. S. Bumps, H. D. Kessler, and M. Hansen, "Titanium-Aluminum System", *Journal of Metals*, TRANSACTIONS AIME, Vol. 194 (June 1952) pp. 609–614.

2. H. R. Ogden, D. J. Maykuth, W. L. Finlay, and R. I. Jaffee, "Mechanical Properties of High Purity Ti-Al Alloys", *Journal of Metals*, TRANSACTIONS AIME, Vol. 197. (February 1953) pp. 267–272.

Three additional papers contain limited information about the mechanical behavior of TiAl base alloys modified by niobium. These three papers are as follows:

3. Joseph B. McAndrew, and H. D. Kessler, "Ti-36 Pct Al as a Base for High Temperature Alloys", *Journal of Metals*, TRANSACTIONS AIME, Vol. 206 (October 1956) pp. 1348–1353.

4. S.M.L. Sastry, and H. A. Lipsitt, "Plastic Deformation of TiAl and $Ti_3Al$", *Titanium* 80 (Published by American Society for Metals, Warrendale, Pa.), Vol. 2 (1980) page 1231.

5. S.M.L. Sastry, and H. A. Lipsitt, "Fatigue Deformation of TiAl Base Alloys", *Metallurgical Transactions*, Vol. 8A (February 1977) pages 299–308.

The first paper above contains a statement that "A Ti-35 pct Al-5 pct Cb specimen had a room temperature ultimate tensile strength of 62,360 psi, and a Ti-35 pct Al-7 pct Cb specimen failed in the threads at 75,800 psi." The two above alloys referred to in the quoted passage are given in weight percent and have approximate compositions in atomic percentages respectively of $Ti_{48}Al_{50}Nb_2$ and $Ti_{47}Al_{50}Nb_3$. It is well-known that the failure of a test specimen in the threads is a strong indication that the specimen was brittle. It is further mentioned in this paper that the niobium containing composition is good for oxidation and creep resistance.

The second paper contains a conclusion regarding the influence of niobium additions on TiAl but offers no specific data in support of this conclusion. The conclusion is that: "The major influence of niobium additions to TiAl is a lowering of the temperature at which twinning becomes an important mode of deformation and thus a lowering of the ductile-brittle transition temperature of TiAl." There is no indication in this article as to whether the ductile-brittle transition temperature of TiAl was lowered to below room temperature. The only niobium containing titanium aluminum alloy mentioned without any reference to properties or other descriptive data is given in weight percent and is Ti-36Al-4Nb. This corresponds in atomic percent to $Ti_{47.5}Al_{51}Nb_{1.5}$, a composition which is quite distinct from those taught and claimed by the Applicant herein as will become more clearly evident below.

The composition described in the fifth reference above, which contains 36.2 weight % of aluminum and 4.65 weight % of niobium in a titanium base composition, when converted to atomic composition is Ti-51Al-2Nb. This composition was studied as is reported at the last sentence of page 301 and the first portion of page 302. As reported on the bottom of page 301 and on top of page 302, the authors concluded that:

> "It has been found that the addition of Nb to the TiAl base composition improves the low temperature ductility of the base composition . . . . The addition of Nb does not significantly alter the fatigue properties of the base composition as can be seen in FIG. 5."

FIG. 5 is quite persuasive that there is no significant alteration of the fatigue properties. There is no indication in the article that room temperature ductility is improved by Nb additions.

BRIEF DESCRIPTION OF THE INVENTION

One object of the present invention is to provide a method of forming a titanium aluminum intermetallic compound having improved ductility and related properties at room temperature.

Another object is to improve the properties of titanium aluminum intermetallic compounds at low and intermediate temperatures.

Another object is to provide an alloy of titanium and aluminum having improved properties and processability at low and intermediate temperatures.

Other objects will be in part apparent and in part pointed out in the description which follows.

In one of its broader aspects, the objects of the present invention are achieved by providing a nonstoichiometric TiAl base alloy, and adding a relatively higher concentration of niobium to the nonstoichiometric composition. The addition is followed by ingot processing of the niobium-containing nonstoichiometric TiAl intermetallic compound. Addition of niobium in the order of approximately 6 to 14 parts in 100 is contemplated and additions in the order of 8 to 12 parts is preferred.

DETAILED DESCRIPTION OF THE INVENTION

Figure 1:
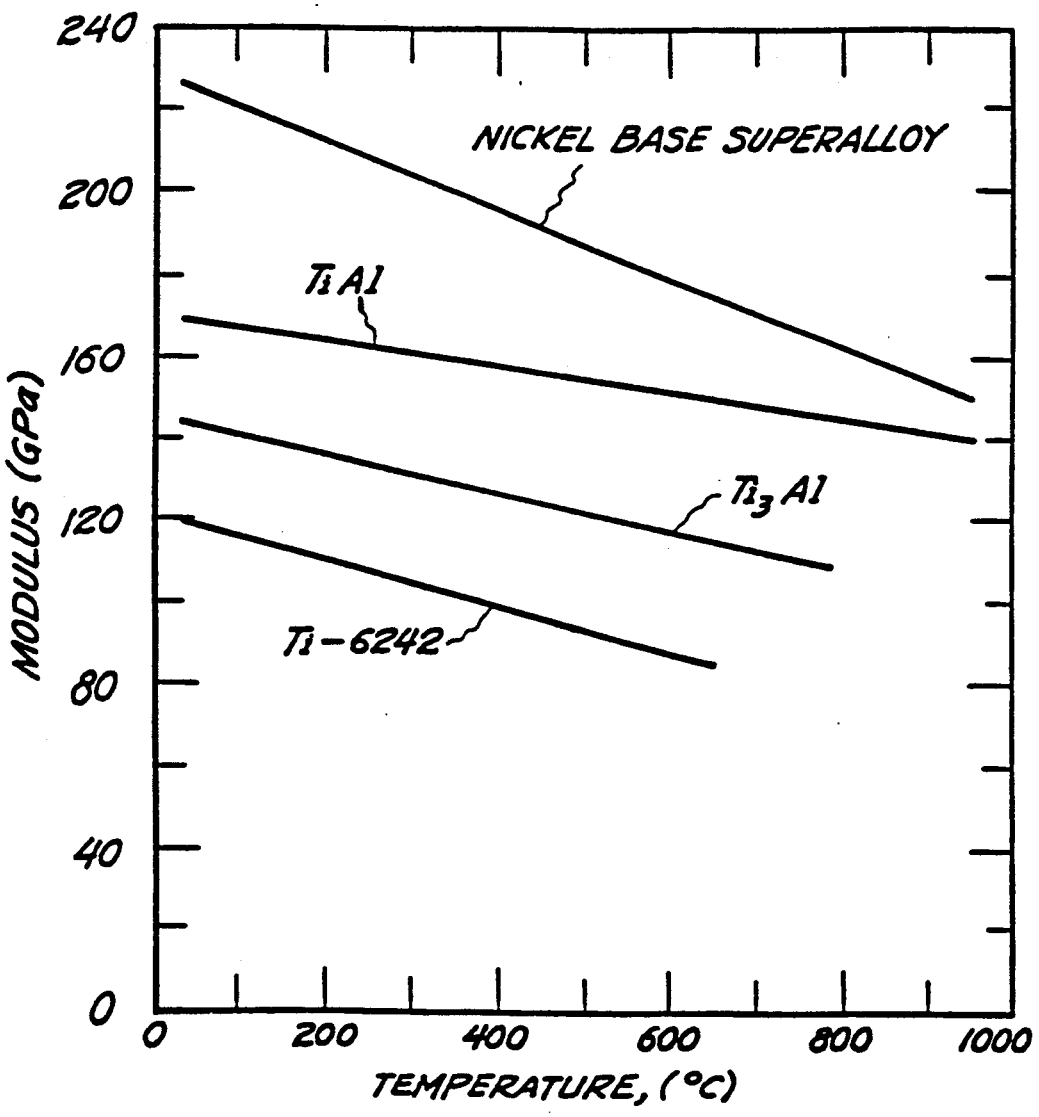
FIG. 1 is a graph illustrating the relationship between modulus and temperature for an assortment of alloys.

It is well known, as is discussed above, that except for its brittleness and processing difficulties the intermetallic compound gamma TiAl would have many uses in industry because of its light weight, high strength at high temperatures, and relatively low cost. The composition would have many industrial uses today if it were not for this basic property defect of the material which has kept it from such uses for many years.

The present inventor found that the gamma TiAl compound could be substantially ductilized by the addition of a small amount of niobium. This finding is the subject of copending application Ser. No. 332,088, filed Apr. 3, 1989.

Further, the present inventor found that a chromium ductilized composition could be remarkably improved in its oxidation resistance with no loss of ductility or strength by the addition of niobium in addition to the chromium. This later finding is the subject of copending application Ser. No. 201,984, filed June 3, 1988.

The inventor has now found that substantial further improvements in ductility can be made by additions of higher concentrations of niobium alone in the range of 8 to 13 atomic percent where this addition is coupled with ingot processing as discussed more fully below.

To better understand the improvements in the properties of TiAl, a number of examples are presented and discussed here before the examples which deal with the novel compositions and processing practices of this invention.

EXAMPLES 1-3

Three individual melts were prepared to contain titanium and aluminum in various stoichiometric ratios approximating that of TiAl. The compositions, annealing temperatures and test results of tests made on the compositions are set forth in Table I.

For each example, the alloy was first made into an ingot by electro arc melting. The ingot was processed into ribbon by melt spinning in a partial pressure of argon. In both stages of the melting, a water-cooled copper hearth was used as the container for the melt in order to avoid undesirable melt-container reactions. Also, care was used to avoid exposure of the hot metal to oxygen because of the strong affinity of titanium for oxygen.

The rapidly solidified ribbon was packed into a steel can which was evacuated and then sealed. The can was then hot isostatically pressed (HIPed) at 950° C. (1740° F.) for 3 hours under a pressure of 30 ksi. The HIPing can was machined off the consolidated ribbon plug. The HIPed sample was a plug about one inch in diameter and three inches long.

The plug was placed axially into a center opening of a billet and sealed therein. The billet was heated to 975° C. (1787° F.) and was extruded through a die to give a reduction ratio of about 7 to 1. The extruded plug was removed from the billet and was heat treated.

The extruded samples were then annealed at temperatures as indicated in Table I for two hours. The annealing was followed by aging at 1000° C. for two hours. Specimens were machined to the dimension of 1.5×3×25.4 mm (0.060×0.120×1.0 in.) for four point bending tests at room temperature. The bending tests were carried out in a 4-point bending fixture having an inner span of 10 mm (0.4 in.) and an outer span of 20 mm (0.8 in.). The load-crosshead displacement curves were recorded. Based on the curves developed, the following properties are defined:

(1) Yield strength is the flow stress at a cross head displacement of one thousandth of an inch. This amount of cross head displacement is taken as the first evidence of plastic deformation and the transition from elastic deformation to plastic deformation. The measurement of yield and/or fracture strength by conventional compression or tension methods tends to give results which are lower than the results obtained by four point bending as carried out in making the measurements reported herein. The higher levels of the results from four point bending measurements should be kept in mind when comparing these values to values obtained by the conventional compression or tension methods. However, the comparison of measurements' results in many of the examples herein is between four point bending tests, and for all samples measured by this technique, such comparisons are quite valid in establishing the differences in strength properties resulting from differences in composition or in processing of the compositions.

(2) Fracture strength is the stress to fracture.

(3) Outer fiber strain is the quantity of 9.71hd, where "h" is the specimen thickness in inches, and "d" is the cross head displacement of fracture in inches. Metallurgically, the value calculated represents the amount of plastic deformation experienced at the outer surface of the bending specimen at the time of fracture.

Figure 2:
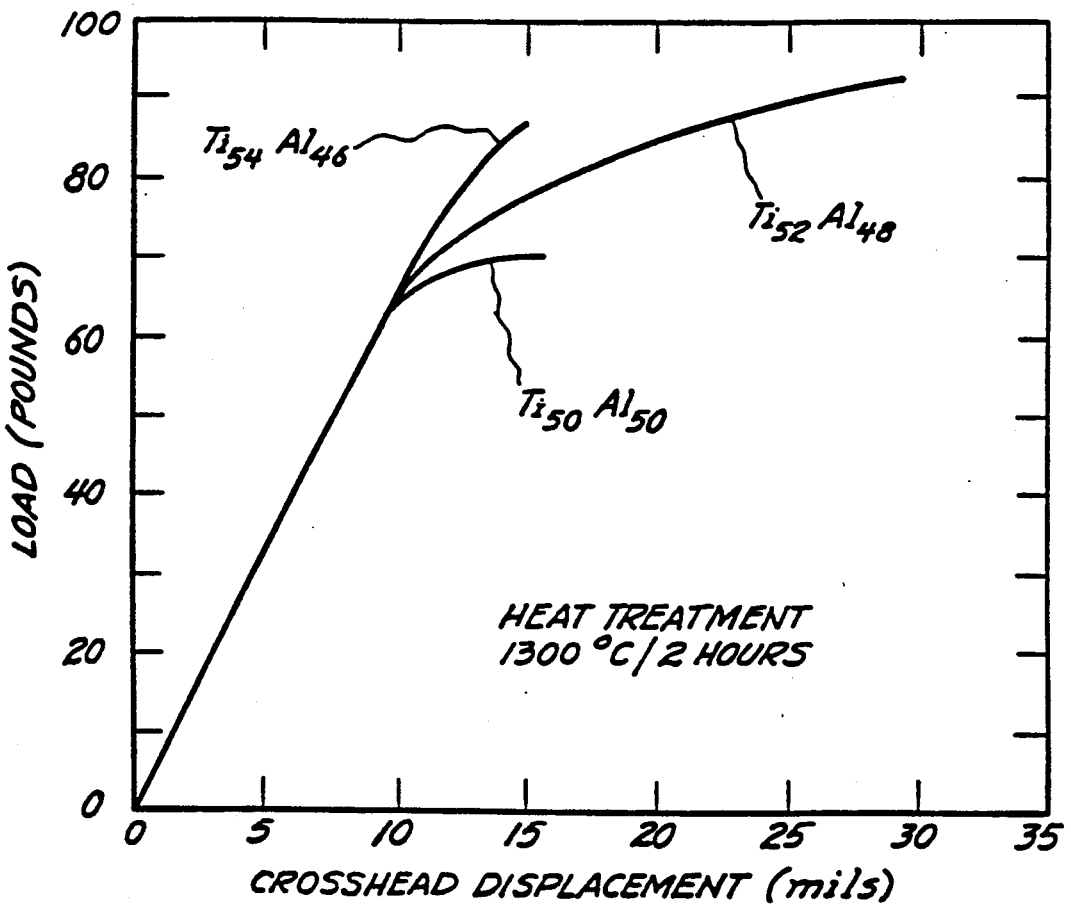
FIG. 2 is a graph illustrating the relationship between load in pounds and crosshead displacement in mils for TiAl compositions of different stoichiometry tested in 4-point bending.

The results are listed in the following Table I. Table I contains data on the properties of samples annealed at 1300° C. and further data on these samples in particular is given in FIG. 2.

TABLE I

| Ex. No. | Gamma Alloy No. | Composit. (at. %) | Anneal Temp (°C.) | Yield Strength (ksi) | Fracture Strength (ksi) | Outer Fiber Strain (%) |
|---|---|---|---|---|---|---|
| 1 | 83 | $Ti_{54}Al_{46}$ | 1250 | 131 | 132 | 0.1 |
| | | | 1300 | 111 | 120 | 0.1 |
| | | | 1350 | * | 58 | 0 |
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| | | | 1400 | 70 | 85 | 0.2 |
| 3 | 85 | $Ti_{50}Al_{50}$ | 1250 | 83 | 92 | 0.3 |
| | | | 1300 | 93 | 97 | 0.3 |
| | | | 1350 | 78 | 88 | 0.4 |

*No measurable value was found because the sample lacked sufficient ductility to obtain a measurement It is evident from the data of this table that alloy 12 for Example 2 exhibited the best combination of properties. This confirms that the properties of Ti-Al compositions are very sensitive to the Ti/Al atomic ratios and to the heat treatment applied. Alloy 12 was selected as the base alloy for further property improvements based on further experiments which were performed as described below.

It is also evident that the anneal at temperatures between 1250° C. and 1350° C. results in the test specimens having desirable levels of yield strength, fracture strength and outer fiber strain. However, the anneal at 1400° C. results in a test specimen having a significantly lower yield strength (about 20% lower); lower fracture strength (about 30% lower) and lower ductility (about 78% lower) than a test specimen annealed at 1350° C. The sharp decline in properties is due to a dramatic change in microstructure due, in turn, to an extensive beta transformation at temperatures appreciably above 1350° C.

EXAMPLES 4–13

Ten additional individual melts were prepared to contain titanium and aluminum in designated atomic ratios as well as additives in relatively small atomic percents.

Each of the samples was prepared as described above with reference to Examples 1–3.

The compositions, annealing temperatures, and test results of tests made on the compositions are set forth in Table II in comparison to alloy 12 as the base alloy for this comparison.

TABLE II

| Ex. No. | Gamma Alloy No. | Composition (at. %) | Anneal Temp (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 4 | 22 | $Ti_{50}Al_{47}Ni_3$ | 1200 | * | 131 | 0 |
| 5 | 24 | $Ti_{52}Al_{46}Ag_2$ | 1200 | * | 114 | 0 |
| | | | 1300 | 92 | 117 | 0.5 |
| 6 | 25 | $Ti_{50}Al_{48}Cu_2$ | 1250 | * | 83 | 0 |
| | | | 1300 | 80 | 107 | 0.8 |
| | | | 1350 | 70 | 102 | 0.9 |
| 7 | 32 | $Ti_{54}Al_{45}Hf_1$ | 1250 | 130 | 136 | 0.1 |
| | | | 1300 | 72 | 77 | 0.2 |
| 8 | 41 | $Ti_{52}Al_{44}Pt_4$ | 1250 | 132 | 150 | 0.3 |
| 9 | 45 | $Ti_{51}Al_{47}C_2$ | 1300 | 136 | 149 | 0.1 |
| 10 | 57 | $Ti_{50}Al_{48}Fe_2$ | 1250 | * | 89 | 0 |
| | | | 1300 | * | 81 | 0 |
| | | | 1350 | 86 | 111 | 0.5 |
| 11 | 82 | $Ti_{50}Al_{48}Mo_2$ | 1250 | 128 | 140 | 0.2 |
| | | | 1300 | 110 | 136 | 0.5 |
| | | | 1350 | 80 | 95 | 0.1 |
| 12 | 39 | $Ti_{50}Al_{46}Mo_4$ | 1200 | * | 143 | 0 |
| | | | 1250 | 135 | 154 | 0.3 |
| | | | 1300 | 131 | 149 | 0.2 |
| 13 | 20 | $Ti_{49.5}Al_{49.5}Er_1$ | + | + | + | + |

*See asterisk note to Table I

+Material fractured during machining to prepare test specimens

For Examples 4 and 5, heat treated at 1200° C., the yield strength was unmeasurable as the ductility was found to be essentially nil. For the specimen of Example 5 which was annealed at 1300° C., the ductility increased, but it was still undesirably low.

For Example 6, the same was true for the test specimen annealed at 1250° C. For the specimens of Example 6 which were annealed at 1300° and 1350° C. the ductility was significant but the yield strength was low.

None of the test specimens of the other Examples were found to have any significant level of ductility.

It is evident from the results listed in Table II that the sets of parameters involved in preparing compositions for testing are quite complex and interrelated. One parameter is the atomic ratio of the titanium relative to that of aluminum. From the data plotted in FIG. 4, it is evident that the stoichiometric ratio or nonstoichiometric ratio has a strong influence on the test properties which formed for different compositions.

Another set of parameters is the additive chosen to be included into the basic TiAl composition. A first parameter of this set concerns whether a particular additive acts as a substituent for titanium or for aluminum. A specific metal may act in either fashion and there is no simple rule by which it can be determined which role an additive will play. The significance of this parameter is evident if we consider addition of some atomic percentage of additive X.

If X acts as a titanium substituent, then a composition $Ti_{48}Al_{48}X_4$ will give an effective aluminum concentration of 48 atomic percent and an effective titanium concentration of 52 atomic percent.

If, by contrast, the X additive acts as an aluminum substituent, then the resultant composition will have an effective aluminum concentration of 52 percent and an effective titanium concentration of 48 atomic percent.

Accordingly, the nature of the substitution which takes place is very important but is also highly unpredictable.

Another parameter of this set is the concentration of the additive.

Still another parameter evident from Table II is the annealing temperature. The annealing temperature which produces the best strength properties for one additive can be seen to be different for a different additive. This can be seen by comparing the results set forth in Example 6 with those set forth in Example 7.

In addition, there may be a combined concentration and annealing effect for the additive so that optimum property enhancement, if any enhancement is found, can occur at a certain combination of additive concentration and annealing temperature so that higher and lower concentrations and/or annealing temperatures are less effective in providing a desired property improvement.

The content of Table II makes clear that the results obtainable from addition of a ternary element to a nonstoichiometric TiAl composition are highly unpredictable and that most test results are unsuccessful with respect to ductility or strength or to both.

EXAMPLES 14–24

Eleven additional samples were prepared as described above with reference to Examples 1–3 to contain titanium aluminide having compositions respectively as listed in Table III.

In addition to listing the test compositions, the Table III summarizes the bend test results on all of the alloys both standard and modified under the various heat treatment conditions deemed relevant.

TABLE III

Four-Point Bend Properties of Nb-Modified TiAl Alloys

| Ex. No. | Gamma Alloy No. | Composit. (at. %) | Anneal Temp (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| | | | 1400 | 70 | 85 | 0.2 |
| 14 | 78 | $Ti_{50}Al_{48}Nb_2$ | 1250 | 139 | 143 | 0.1 |
| | | | 1300 | 111 | 134 | 0.4 |
| | | | 1350 | 57 | 67 | 0.1 |
| 15 | 119 | $Ti_{51}Al_{45}Nb_4$ | 1250 | 150 | 178 | 0.4 |
| | | | 1300 | *— | 69 | 0 |
| 16 | 40 | $Ti_{50}Al_{46}Nb_4$ | 1250 | 136 | 167 | 0.5 |
| | | | 1300 | 124 | 176 | 1.0 |
| | | | 1350 | 86 | 100 | 0.1 |
| 17 | 66 | $Ti_{49}Al_{47}Nb_4$ | 1250 | 138 | 160 | 0.4 |
| | | | 1300 | 126 | 167 | 0.8 |
| | | | 1350 | *— | 64 | 0 |
| 18 | 55 | $Ti_{48}Al_{48}Nb_4$ | 1300 | 126 | 147 | 0.4 |
| | | | 1350 | 104 | 135 | 0.6 |
| 19 | 92 | $Ti_{46}Al_{48}Nb_6$ | 1350 | *— | 88 | 0 |
| 20 | 52 | $Ti_{48}Al_{44}Nb_8$ | 1250 | 125 | 172 | 0.4 |
| | | | 1300 | *— | 131 | 0 |
| | | | 1350 | *— | 125 | 0 |
| 21 | 67 | $Ti_{44}Al_{48}Nb_8$ | 1250 | 151 | 161 | 0.2 |
| | | | 1300 | 140 | 161 | 0.2 |
| | | | 1350 | 119 | 153 | 0.7 |
| 22 | 53 | $Ti_{46}Al_{42}Nb_{12}$ | 1250 | *— | 152 | |
| | | | 1300 | *— | 138 | 0 |
| | | | 1350 | *— | 181 | 0 |
| 23 | 123 | $Ti_{40}Al_{48}Nb_{12}$ | 1300 | *— | 67 | 0 |
| | | | 1350 | 107 | 138 | 0.8 |
| 24 | 137 | $Ti_{36}Al_{48}Nb_{16}$ | **— | **— | **— | **— |

*No measurable value was found because the sample lacked sufficient ductility to obtain a measurement

**The material was too brittle to be machined into samples for test

From Table III, it is evident that alloys 12, 78, 55, 92, 67, 123, and 137 contained 0, 2, 4, 6, 8, 12, and 16 atomic percent of niobium respectively as an additive to the base composition $Ti_{52}Al_{48}$. From the data listed in Table III, it can be concluded that the rapid solidification of the listed compositions does not improve room temperature ductility.

If the results are compared based on the same heat treatment (1300° C.) being applied to each sample, then it may be concluded from the data of Table III, for the yield strength which could be measured, that the progressive addition of greater concentrations of niobium results in a progressive increase in the yield strength but also resulted in a progressive decrease in the ductility. This finding is consistent with the teaching of McAndrew in his article 3 above, but contradicts the Sastry teaching in his above articles 4 and 5.

From Table III it is also evident that at the 8 and 12 atomic percent additive level (see alloys 67 and 123) a better combination of strength and ductility can be obtained if the specimens are heat treated at the 1350° C. level but ductility is still below 1%.

For samples having lower concentrations of niobium, such as samples 78 and 55, it was found that imparting improvements to the samples by such heat treatment is not feasible as the improvement achieved are not as significant.

A finding results from comparing the test results for alloys 55, 66, 40, and 119 in Table III. This comparison is made with respect to samples having a 4 atomic percent level of niobium additive but different stoichiometric ratios of titanium and aluminum. It has been discovered based on the study of these compositions that the aluminum concentration can be reduced slightly to obtain significant increases in ductility without sacrificing the attractive strength. However, aluminum concentration cannot be reduced below 46% without substantial elimination of ductility. Even where the aluminum is at 46% or above the ductility is at or below 1%.

Considering the data of Table III it is apparent that there is an optimum concentration of the niobium additive of between 4 and 12 atomic percent if appropriate adjustments are made in the aluminum concentration and the annealing temperature according to the teaching contained in Table III.

All of the foregoing test samples were prepared by rapid solidification. Also, the testing of all of the test samples listed in the foregoing tables was done by four-point bending tests.

TENSILE TESTING vs. FOUR-POINT BEND TESTING

As noted above, all of the foregoing examples were prepared by rapid solidification processing and the testing was done by four-point bending tests. All of the data listed in the above tables is from this source.

The results of such preparation and testing as set forth in Examples 20 through 22 is that the material having 8 to 12 atomic percent of niobium in the titanium aluminide had very limited ductility for the most part with the one exception that the $Ti_{44}Al_{48}Nb_8$ which was processed at 1350° annealing temperature.

I have now discovered that compositions having niobium additive in the relatively larger quantities of 8–12 or more atomic percent can be given very significant ductility if the processing is carried out by conventional ingot metallurgy techniques and by conventional tensile testing techniques rather than the rapid solidification and four-point bending tests as set forth in the Examples 20 through 24.

The principal distinguishing processing step here is that the ingot metallurgy technique involved a melting of the ingredients and solidification of the ingredients into an ingot. The rapid solidification method by contrast involves the formation of a ribbon by the melt spinning method followed by the consolidation of the ribbon into a fully dense coherent metal sample.

However, before getting to the ingot processing, a note of caution is warranted. The caution concerns the different measurements which are usually used in testing ingot processed samples.

The ingot processed samples are usually tested by conventional tensile tests employing tensile bars which are prepared expressly for this purpose.

In order to make a fair comparison between the properties of alloys prepared by rapid solidification and alloys prepared by conventional ingot processing a series of tests were conducted of the properties of rapidly solidified alloys using conventional tensile bar testing.

EXAMPLE 25

TENSILE BAR TESTING OF RAPIDLY SOLIDIFIED SAMPLES

For this purpose, a series of conventional pins were prepared from the alloy samples which had been prepared by rapid solidification, most of which are listed in Table III above. In addition, however, a gamma TiAl alloy with niobium doping was prepared by the rapid solidification method described above. This alloy is identified as alloy 132 and it contained 6 atom percent of the niobium dopant. A set of pints were prepared from each of the test alloys listed in Table IV below including a set of pins prepared from alloy 132.

The different pins were separately annealed at the different temperatures listed in Table IV below. Following the individual anneals, the pins were aged at 1000° C. for two hours. After the anneal and aging, each pin was machined into a conventional tensile bar and conventional tensile tests were performed on the resulting bars. The results of the tensile tests are listed in Table IV immediately below.

TABLE IV

Conventional Tensile Bar Testing of Room Temperature Tensile Properties of Gamma RSG Alloys

| Ex. No. | CFG No. | Composition | Heat Treat Temp. °C. | Strength (ksi) | Strength (ksi) | Plastic Elongation (%) | Weight Loss After 48 hrs @ 982° C. in Static Air (mg/cm$^2$) |
|---|---|---|---|---|---|---|---|
| 2 | 12 | Ti—48Al | 1250 | —* | 88 | 0 | |
| | | | 1300 | 77 | 92 | 2.1 | |
| | | | 1350 | 68 | 81 | 1.1 | 31 |
| 14 | 78 | Ti—48Al—2Nb | 1300 | 90 | 103 | 1.7 | |
| | | | 1325 | 82 | 82 | 0.2 | 7 |
| 15 | 119 | Ti—45Al—Nb | 1225 | 124 | 124 | 0.2 | |
| | | | 1250 | 120 | 120 | 0.2 | |
| | | | 1275 | —* | 87 | 0 | |
| 16 | 40 | Ti—46Al—4Nb | 1275 | —* | 105 | 0 | |
| | | | 1300 | 101 | 110 | 0.7 | 4 |
| | | | 1325 | 96 | 96 | 0.2 | |
| 17 | 66 | Ti—47Al—4Nb | 1275 | 109 | 110 | 0.4 | |
| | | | 1300 | 100 | 101 | 0.3 | |
| | | | 1325 | 95 | 105 | 0.8 | |
| 18 | 55 | Ti—48Al—4Nb | 1275 | 102 | 105 | 0.5 | |
| | | | 1325 | 84 | 93 | 1.2 | |
| | | | 1350 | 81 | 87 | 0.7 | |
| 25 | 132 | Ti—46Al—6Nb | 1275 | —* | 120 | 0 | |
| | | | 1300 | 125 | 126 | 0.4 | |
| | | | 1325 | —* | 71 | | |
| 19 | 92 | Ti—48Al—6Nb | 1325 | 96 | 103 | 0.5 | 5 |
| 23 | 123 | Ti—48Al—2Nb | 1325 | —* | 106 | 0 | |
| | | | 1350 | 92 | 99 | 1.3 | 1 |
| | | | 1375 | 84 | 90 | 0.5 | |
| | | | 1400 | —* | 82 | 0.1 | |

*No measurable value was found because the sample lacked sufficient ductility to obtain a measurement In addition, as is evident from the data presented in Table IV, oxidation resistance tests were carried out.

If a comparison is made between the alloys listed in Table IV which contained different percentages of niobium dopant and the base gamma TiAl alloy which was free of the niobium (alloy 12) it is evident that there is essentially no overall improvement in ductility. There are some alloys for which significant strength improvement is formed but in general where the strength is significantly higher the ductility is quite low. For example, for alloy 119, alloy strength is quite high (124 ksi and 120 ksi) but the corresponding ductility is quite low (i.e. 0.1).

There is an overall improvement in oxidation resistance from the data shown in Table IV.

EXAMPLE 26A

INGOT METALLURGY AND TENSILE BAR TESTING

A second lot of a number of the alloy compositions which are listed in the tables above were prepared by conventional ingot metallurgy processing rather than by the rapid solidification processing used in the first lots prepared as described in the first lots prepared as described in the earlier examples. Where the alloy composition of the ingot processed alloy is the same as an alloy of an earlier example, the same example number is repeated but the ingot processing is evidenced by adding an "A" to the example number. One additional alloy designated as alloy 26A was also prepared by ingot processing.

The properties of the alloys so prepared were tested and the test results are listed in Table V immediately below.

TABLE V

Room Temperature Tensile Properties of Cast and Forged Gamma TiAl Alloys

| Ex. No. | Gamma CFG No. | Atomic Composition | Homogenization Temp °C. | Heat Treat Temp. °C. | Yield Strength (ksi) | Fracture Strength (ksi) | Plastic Elongation (%) | Weight Loss After 48 hrs @ 982° C. in Static Air (mg/cm²) |
|---|---|---|---|---|---|---|---|---|
| 2A | 12A | Ti—48Al | 1250 | 1300 | 54 | 73 | 2.6 | 32 |
| | | | 1250 | 1325 | 50 | 71 | 2.3 | |
| | | | 1250 | 1350 | 57 | 77 | 2.1 | |
| 16A | 40A | Ti—46Al—4Nb | 1250 | 1250 | 93 | 96 | 0.8 | |
| | | | 1250 | 1275 | 89 | 99 | 1.4 | |
| | | | 1250 | 1300 | 87 | 100 | 1.6 | 3 |
| 18A | 55A | Ti—48Al—4Nb | 1250 | 1275 | 70 | 77 | 1.3 | |
| | | | 1250 | 1300 | 57 | 73 | 2 | 2 |
| | | | 1250 | 1325 | 54 | 71 | 2 | |
| | | | 1250 | 1350 | 57 | 78 | 2.3 | |
| | | | 1400 | 1300 | 65 | 79 | 2.2 | |
| | | | 1400 | 1325 | 62 | 77 | 2 | |
| | | | 1400 | 1350 | 63 | 82 | 2.2 | |
| 26A | 151A | Ti—49Al—4Nb | 1400 | 1300 | 53 | 60 | 1.4 | |
| | | | 1400 | 1325 | 50 | 63 | 2.1 | |
| | | | 1400 | 1350 | 52 | 65 | 2.1 | |
| | | | 1400 | 1375 | 52 | 66 | 1.6 | |
| 21A | 67A | Ti—48Al—8Nb | 1400 | 1300 | 74 | 82 | 1.7 | 2 |
| | | | 1400 | 1325 | 70 | 82 | 2 | |
| | | | 1400 | 1350 | 67 | 83 | 2.2 | |
| | | | 1400 | 1375 | 70 | 87 | 2.6 | |
| 23A | 123A | Ti—48Al—12Nb | 1400 | 1325 | 72 | 82 | 1.6 | |
| | | | 1400 | 1350 | 72 | 88 | 2 | |
| | | | 1400 | 1375 | 69 | 87 | 2.3 | 1 |

*Example 2A corresponds to Example 2 above in the composition of the alloy used in the example. However, Alloy 12A of Example 2A was prepared by ingot metallurgy rather than by the rapid solidification method of Alloy 12 of Example 2. The tensile and elongation properties were tested by the tensile bar method rather than the four point bending testing used for Alloy 12 of Example 2. The other alloys listed in Table V were also prepared by conventional ingot metallurgy. All tensile data in Table V was obtained by conventional tensile bar testing.

The ingot processing procedure, which is also designated cast and forge processing herein, was essentially the same for each of the alloy samples prepared and was as follows:

In the ingot melting procedure, the ingot is prepared to a dimension of about 2" in diameter and about ½" thick in the approximate shape of a hockey puck. Following the melting and solidification of the hockey puck shaped ingot, the ingot was enclosed within a steel annulus having a wall thickness of about ½" and having a vertical thickness which matched identically that of the hockey puck ingot. Before being enclosed within the retaining ring, the hockey pucked ingot was homogenized by being heated to 1250° C.–1400° C. for two hours. The assembly of the hockey puck and retaining ring were heated to a temperature of about 975° C. The heated sample and containing ring were forged to a thickness of approximately half that of the original thickness.

After the forged ingot was cooled, a number of pins were machined out of the ingot for a number of different heat treatments. The different pins were separately annealed at the different temperatures listed in Table V above. Following the individual anneals, the pins were aged at 1000° C. for two hours. After the anneal and aging, each pin was machined into a conventional tensile bar and conventional tensile tests were performed on the resulting bars. The results of the tensile tests are listed in Table V above.

As is evident from the table, the four samples of alloy 67A were individually annealed at the four different temperatures and specifically 1300°, 1325°, 1350°, and 1375° C. The yield strength of these samples is significantly improved over the base alloy 12A. For example, the sample annealed at 1300° C. had a gain of about 37% in yield strength over the alloy 12A which was annealed at a same temperature. Other gains are of the same order of magnitude. This gain in strength was realized with a reduction in ductility but the ductility of the sample of alloy 67A annealed at 1300° C. is remarkably improved over a similar sample for Example 21 of Table III. The other heat-treated samples show comparable gains in strength with modest reduction in ductility over the base alloy 12A and in some cases with a modest gain in ductility. The combination of improved strength with moderately reduced ductility or even moderately increased ductility when considered together make these gamma titanium aluminide compositions unique.

Returning again to consideration of the test results that are listed in Table V and by comparing it with the data, for example, listed in Table IV, it is evident that the yield strengths determined for the rapidly solidified alloys as reported in Table IV are somewhat higher than those which are determined for the ingot processed metal specimens as reported in Table V. Also, it is evident that the plastic elongation of the samples prepared through the ingot metallurgy route have higher ductility than those which are prepared by the rapid solidification route. The results listed, however, provide a good comparative basis in having alloy 12A which was prepared by ingot metallurgy listed in Table V and alloy 12 which was prepared by rapid solidification listed in Table IV. However, from a general comparison of the data of Table V, with the data of Table IV, it is evident that for the higher concentration of niobium additive, the preparation of the alloy samples by the ingot metallurgy processing technique and the testing of the samples by conventional tensile bar testing techniques demonstrates that the higher niobium alloys prepared by ingot metallurgy techniques are very desirable for those applications which require a higher ductility. Generally speaking, it is well known that processing by ingot metallurgy is far less expensive than processing through melt spinning or rapid solidification inasmuch as here is no need for the expensive melt spinning step itself nor for the consolidation step which must follow the melt spinning when the rapid solidification processing is employed.

OXIDATION RESISTANCE

The alloys of this invention also display superior oxidation resistance. The oxidation tests reported in Table IV are static tests. The static tests are performed by heating the alloy sample to 982° C. for 48 hours and then cooling and weighing the heated sample. The weight gain is divided by the surface area of the sample in square centimeters. The result is stated in milligrams of weight gain per square centimeter of surface area for each sample.

The data given in Table V is determined on the same static basis.

Figure 4:
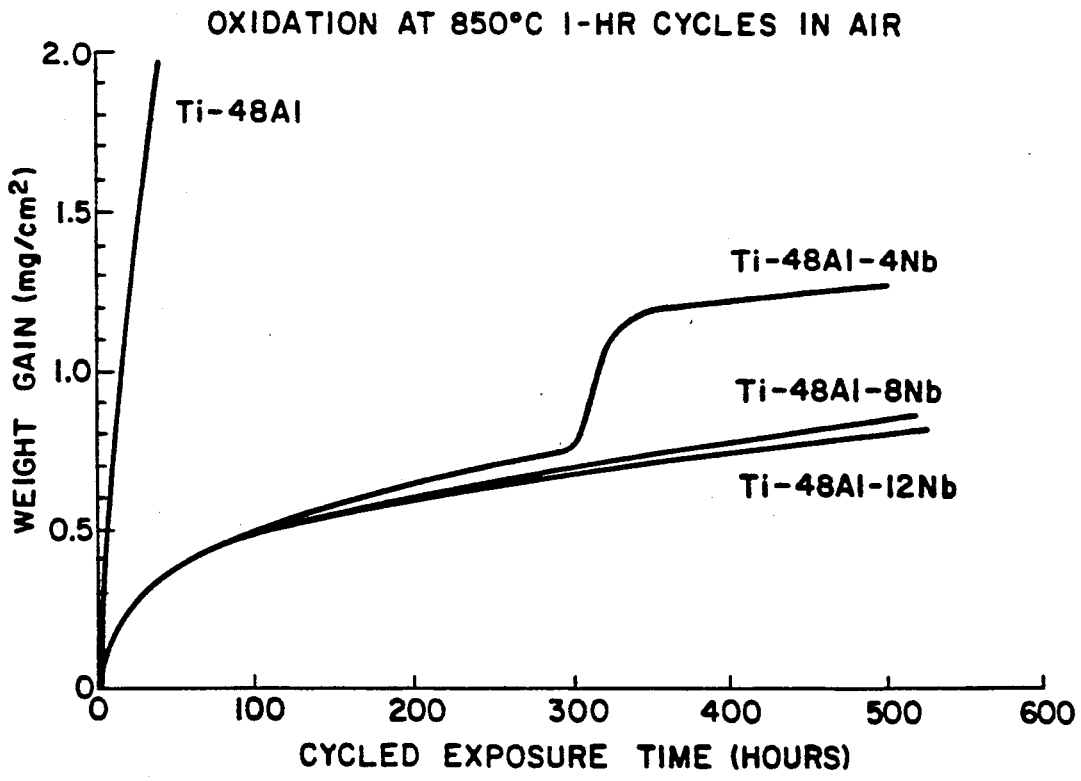
FIG. 4 is a graph in which weight gain in $mg/cm^2$ is plotted against dynamic exposure time in hours.

A number of dynamic oxidation resistance tests were performed on a number of the alloys as listed in Table V. The data from these tests are plotted in FIG. 4. In FIG. 4, the weight gain in mg/cm$^2$ from oxidation of alloy samples as marked is plotted against dynamic exposure to oxidation at 850° C. By dynamic or cycled exposure to an oxidizing atmosphere at elevated temperature is meant that the test sample is cycled through a series of heatings and coolings and that the sample is weighed each time it has cooled to room temperature. The heating is to 850° C. in each case and the sample is maintained at the 850° C. temperature during each cycle for 50 minutes. Cooling is not a forced cooling but rather is a cooling in an ambient room temperature atmosphere. The cooling, weighing, and return to the furnace for testing to the 850° C. temperature takes in the order of ten minutes for an average size sample. The heating to temperature and cooling from temperature is not part of the 50-minute period during which the sample is maintained at temperature.

The data plotted in FIG. 4 is a plot of the weight and of the changing weight of the four samples tested. From the plot of FIG. 4, it is evident that the alloys having 8 and 12 atom percent niobium dopant were by far the best compositions from the point of view of cyclic oxidation resistance.

Figure 3:
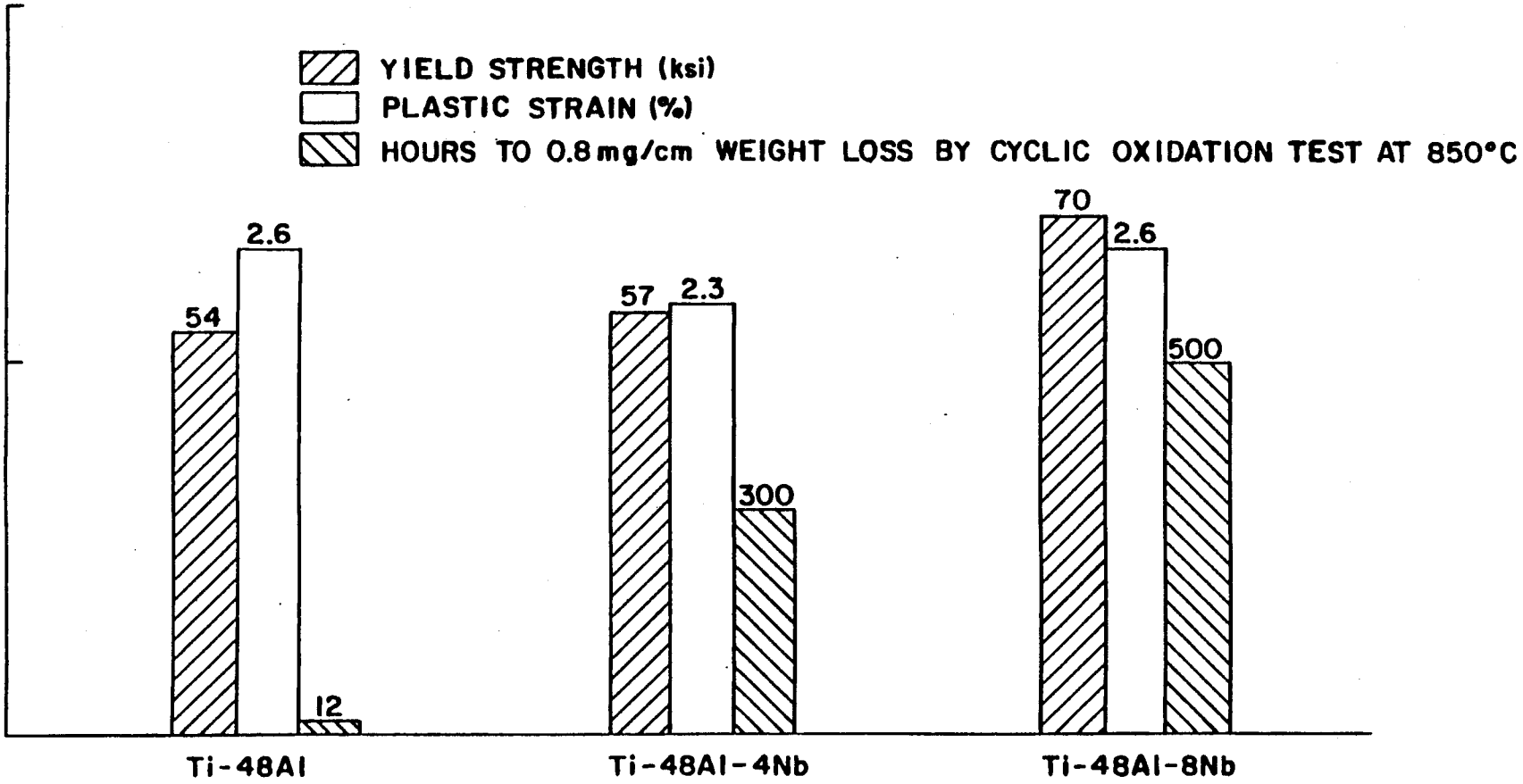
FIG. 3 is a bar graph illustrating alloy properties on a comparative basis.

FIG. 3 presents similar data but on a different basis. In FIG. 3, the oxidation resistance is displayed on the basis of the time needed for the sample to reach a weight gain level of 0.8 mg/cm$^2$. For the $Ti_{44}Al_{48}Nb_8$ alloy, the time is 500 hours.

FIG. 3 also presents the relevant strength and ductility data for the respective alloys.

Clearly, from the data plotted in FIGS. 3 and 4, it may be seen that the ingot processed alloy $Ti_{48-37}Al_{46-49}Nb_{6-14}$ is a novel and unique alloy having unusual and novel sets of properties.

What is claimed is:

1. An aged niobium modified titanium aluminum alloy, said alloy consisting essentially of titanium, aluminum, and niobium in the following atomic ratio:

$Ti_{48-37}Al_{46-49}Nb_{6-14}$, said alloy having been prepared by ingot metallurgy.

2. An aged niobium modified titanium aluminum alloy, said alloy consisting essentially of titanium, aluminum, and niobium in the atomic ratio of:

$Ti_{46-38}Al_{48}Nb_{6-14}$, said alloy having been prepared by ingot metallurgy.

3. An aged niobium modified titanium aluminum alloy, said alloy consisting essentially of titanium, aluminum, and niobium in the following atomic ratio:

$Ti_{46-39}Al_{46-49}Nb_{8-12}$, said alloy having been prepared by ingot metallurgy.

4. A niobium modified titanium aluminum alloy, said alloy consisting essentially of titanium, aluminum, and niobium in the atomic ratio:

$Ti_{44-40}Al_{48}Nb_{8-12}$, said alloy having been prepared by ingot metallurgy.

5. A niobium modified titanium aluminum alloy, said alloy consisting essentially of titanium, aluminum, and niobium in the following atomic ratio:

$Ti_{44}Al_{48}Nb_8$, said alloy having been prepared by ingot metallurgy.

6. As an article of manufacture, a structural member, said member being formed of an aged niobium modified titanium aluminum alloy consisting essentially of titanium, aluminum, and niobium in the following atomic ratio:

$Ti_{44-37}Al_{46-49}Nb_{6-14}$, said alloy having been prepared by ingot metallurgy.

7. As an article of manufacture, a structural member, said member being formed of an aged niobium modified titanium aluminum alloy consisting essentially of titanium, aluminum, and niobium in the following atomic ratio:

$Ti_{46-38}Al_{48}Nb_{6-14}$, said alloy having been prepared by ingot metallurgy.

8. As an article of manufacture, a structural member, said member being formed of an aged niobium modified titanium aluminum alloy consisting essentially of titanium, aluminum, and niobium in the following atomic ratio:

$Ti_{46-39}Al_{46-49}Nb_{8-12}$, said alloy having been prepared by ingot metallurgy.

9. As an article of manufacture, a structural member, said member being formed of a niobium modified titanium aluminum alloy consisting essentially of titanium, aluminum, and niobium in the following atomic ratio:

$Ti_{44-40}Al_{48}Nb_{8-12}$, said alloy having been prepared by ingot metallurgy.

10. As an article of manufacture, a structural member, said member being formed of a niobium modified titanium aluminum alloy consisting essentially of titanium, aluminum, and niobium in the following atomic ratio:

$Ti_{44}Al_{48}Nb_{8}$, said alloy having been prepared by ingot metallurgy.

* * * * *